US006217079B1

(12) United States Patent
Fabel et al.

(10) Patent No.: US 6,217,079 B1
(45) **Date of Patent: *Apr. 17, 2001**

(54) MULTI-PART NON-IMPACT PRINTER AIRBILL FORM

(75) Inventors: Warren M. Fabel, Delray Beach; Glen A. Auchter, Parkland, both of FL (US)

(73) Assignee: Laser Substrates, Inc., Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/293,633

(22) Filed: Apr. 15, 1999

Related U.S. Application Data

(63) Continuation-in-part of application No. 08/377,126, filed on Jan. 23, 1995, now Pat. No. 5,899,504.

(51) Int. Cl.[7] ..... B42D 15/00

(52) U.S. Cl. ..... 283/110; 283/109; 283/111; 283/79; 283/81; 283/61; 283/62; 462/2; 462/6; 462/900; 462/25; 229/301; 229/302; 229/303; 229/304

(58) Field of Search ..... 283/79, 80, 81, 283/101, 109, 110, 111; 462/18, 22, 26, 2, 6, 900, 901, 25, 64–68; 229/301–304, 116, 117

(56) References Cited

U.S. PATENT DOCUMENTS

| | | | | |
|---|---|---|---|---|
| 4,323,608 | * | 4/1982 | Denny et al. | 428/43 |
| 4,850,613 | * | 7/1989 | Instance | 281/1 |
| 5,193,850 | * | 3/1993 | Lombardo | 281/2 |
| 5,366,145 | * | 11/1994 | Sauerwine | 229/304 |
| 5,421,620 | * | 6/1995 | Sauerwine | 283/116 |
| 5,487,566 | * | 1/1996 | Hedge, Jr. | 283/56 |
| 5,573,277 | * | 11/1996 | Petkosek | 283/79 |
| 5,833,129 | * | 11/1998 | Smith | 229/92.8 |
| 5,899,504 | * | 2/2000 | Fabel | 283/109 |
| 6,010,159 | * | 2/2000 | Warther | 283/61 |
| 6,021,942 | * | 2/2000 | Monico | 283/375 |

* cited by examiner

*Primary Examiner*—A. L. Wellington
*Assistant Examiner*—Alisa L Thurston
(74) *Attorney, Agent, or Firm*—Ted W. Whitlock

(57) ABSTRACT

A multi-part, partially pre-printed form useful as an airbill has address information printed thereon by a non-impact printer. Different configurations of the form are described, including panels overlappingly affixed together by an adhesive having removable strips defined by cuts through the top overlapping panels. The center panel is transparent or at least translucent. The address information printed on the outer panels is in a mirror image format relative to the information printed on the transparent panel.

22 Claims, 7 Drawing Sheets

MULTI-PART NON-IMPACT PRINTER AIRBILL FORM

CROSS REFERENCE TO RELATED APPLICATION

This is a continuation-in-part of U.S. patent application Ser. No. 08/377,126, filed Jan. 23, 1995, now U.S. Pat. No. 5,899,504.

BACKGROUND OF THE INVENTION

1. Field of the Invention

This invention relates to a multi-part mailing form for use with a non-impact printer, and more particularly, to an airbill form which may be used for addressing packages sent by an overnight mail service.

2. Background Information

Overnight air courier services have become a common mode to send original documents and goods. Examples of such services include the Express Mail service of the United States Postal Service, Federal Express, United Parcel Service, DHL, Airborne, and many others. Most commercial air courier services utilize a similar multi-part airbill form comprising several layers of superimposed sheets, each of which must bear certain address information. The name of the shipper and the name of the recipient are printed once and appear on all sheets of the airbill form.

Current multi-part airbill forms typically have four sheets: one sheet for the sender, one sheet for the recipient signature as a proof of receipt, one sheet for the package, and one sheet for the air courier's billing department. Many of the various multi-part airbill forms used by air courier services have a peel away backing which exposes a pressure sensitive adhesive for affixing the airbill form to the package being sent.

In order to use these airbill forms, it is necessary to inscribe the addresses of both the recipient and the sender on each of the sheets of the airbill form. Carbon paper or coatings of microcapsules are normally used to permit the user to add the information only one time on the top sheet and still have it appear on the remaining sheets. Nevertheless, the address information must be added to the airbill form by either a typewriter, an impact printer, or by hand. Most offices today utilize computers because of their well-known advantages over typewriters and manually prepared documents. Further, most computer systems used in offices are linked to a non-impact type printer, such as the laser printer or ink jet printer, because of the speed and quiet operation of non-impact printers compared to the older impact printers or typewriters.

Because of the non-impact type of printing equipment used in modern offices, the address information added to air courier airbill forms must be done manually. This results in inefficient use of time if done by typewriter or, if done by hand, can leave the air courier company with the problem of reading the handwriting of someone else. Though manually adding the address information to airbill forms may be done easily enough where a small number of packages are to be sent, it is very inefficient where a large number of packages are to be sent. In the latter case, it is desirable to use a computer and associated printer to prepare the airbill forms. For example, where a mail order vendor ships merchandise by overnight air courier, many hundreds or thousands of airbill forms must be prepared daily and manual preparation of the airbill forms is very tedious and difficult. With current airbill forms, the only manner of using a computer is to utilize an impact printer, which is both slow and noisy. Non-impact printers, which are faster and quieter than impact printers, cannot be used because of the requirement to have the address information on each sheet of the existing multi-part airbill forms.

What is needed is an air courier airbill form which can be printed using a non-impact printer.

SUMMARY OF THE INVENTION

In accordance with one aspect of the invention, there is provided a multi-part form for use as a mailing form for placement on a package, in which address information is printed by a non-impact printer on one side of the form proximate to the time the form is to be used. The form includes a substantially opaque first panel on which certain information, e.g., address information, can be printed and a substantially transparent or translucent panel on which certain information, such as an address, can be printed. The transparent panel is divided from the first panel by means permitting the folding of the first panel over the transparent panel. Advantageously, the information printed on the form can be printed on one and the same face of each of the panels, thus allowing for printing by a non-impact printer in communication with a computer having a database which holds information which can be directed to be printed on the form. Preferably, the address information printed on the transparent panel is a mirror image to the normally readable address information printed on the first panel. Further, there is included means for affixing the one printed face of the transparent panel to the package and means for affixing the back or opposing face of the non-impact printed face of the first panel to another portion of the form or to the package.

A second embodiment of the invention concerns a multi-part form comprising a plurality of separate panels affixed together as a single sheet for use as a mailing form, e.g., airway bill, waybill, bill of lading, or the like, on a package. The panels are folded over to be superimposed with one another for use as a multi-part, manifold form. Address information can be printed on one and the same face of each panel of the form by a single pass through a non-impact printer proximate to the time the form is used. This embodiment having a plurality of panels affixed together comprises at least a first substantially opaque panel and a substantially transparent or substantially translucent panel. For convenience, the transparent or translucent panel is hereinafter referred to as the "transparent panel" but would be understood to be either substantially transparent or translucent such that printed information disposed on one face of this panel shows through and can be read from the other face. The panels can also be independently pre-printed on either face with certain background colors or information, e.g., instructions for use.

The first panel, which is a top panel when the form is in folded configuration and placed on a package, is preferably a paper material having a substantially white background and capable of being printed on by a non-impact printer. The transparent panel, forming a bottom panel when placed on a package in folded configuration, is preferably a substantially transparent or translucent paper or plastic, also capable of being printed on by a non-impact printer.

In a preferred variant of this second embodiment, the mailing form comprises at least three panels and is described herein as having three panels. The first and second panels form each end of a single sheet and are separated from each other, adjoined by a third substantially transparent or translucent panel (hereinafter "the transparent panel") affixed therebetween. The first and second panels are preferably substantially light-colored, or white, background paper capable of being printed on by a non-impact printer. The transparent panel is preferably a substantially transparent or translucent paper or plastic also capable of being printed on by a non-impact printer.

In this variation of the second embodiment, each of the panels is overlapped with its adjacent panel and forms a section approximately one-third the area of the mailing form such that the first and second panels can be folded over the transparent panel to form a three-part, manifold mailing form. The transparent panel can be positioned such that the printed face contacts the package such that the address information printed thereon is readable therethrough. The non-impact-printed faces of the first and second panels, being folded over the transparent third panel, position the printed face of those panels such that they are facing away from the package and are thereby also readable in that folded configuration when not covered by an overlying opaque sheet.

Further, this second embodiment of the subject invention comprises a means for affixing at least a portion of the printed face of the transparent third panel to the package. A means can also be provided for affixing the second panel in folded configuration to the transparent panel or to the package, and the first panel to either the second panel or to the package in the folded configuration. Preferably, these affixing means include disposing adhesive in a strategic position across the width of the panels so that the panels adjoin in a folded configuration to provide a three-part mailing form. This embodiment thus provides a three-part, manifold mailing form wherein the transparent panel is used as the bottom layer of the manifold form and is permanently affixed to a package. The other two panels are affixed to their respective underlying panel or to the package, but are removable therefrom by a separation means, e.g., a perforation.

In accordance with another aspect of the invention, there is provided a method of using a multi-part form, as described hereinabove, as an address form for a package. The form can be pre-printed to include colored edges or borders or can also include instructional information. The method includes the steps of printing the address information on the first and transparent panels on one face of the form, such that the address information printed on the transparent panel is a mirror image of the normally readable address information printed on one or more of the panels. Further, the method includes the steps of affixing the one printed-on face of the transparent panel to the package, folding the opaque panels over the transparent panel, and affixing the opaque panels to one of another portion of the form or to the package.

As the method specifically applies to the second embodiment, information, such as an address, can be printed by a non-impact printer on one and the same face of each of three panels of the form. The first panel and the second panel are printed in a configuration such that they are readable from one direction, i.e., in a normal left to right configuration, when the printed face is exposed or positioned to face away from the package. The transparent panel is printed such that the information is a mirror image to the information printed on the first and second panels. The non-impact printed face of the transparent panel can then be affixed to the package by use of the affixing means such that the printing shows through the transparent panel in a normal, left-to-right, readable manner. The second panel is then folded over and affixed to the transparent panel or to the package. The first panel can then be folded over the second and transparent panels and affixed to the second panel or package to form a mailing form or label having three parts folded over one another, each readable in the same direction.

In accordance with another aspect of the invention, there is provided a method of manufacturing the first embodiment of a pre-printed multi-part mailing form for a package. The form of the first embodiment includes a pair of transparent sheets, each forming one ply of the two-ply form. The method includes the steps of printing foreground information and a background color on one of the sheets. The background color is printed only on a portion of the one sheet and the foreground information on that portion being printed in a mirror image format relative to the remaining foreground information. The method further includes the steps of coating an adhesive on one of the sheets and affixing the sheets together so that the adhesive is between the sheets to adhere the plies together.

A method for manufacturing the second embodiment of the multi-part mailing form for a package is also included as part of the subject invention. The method comprises the steps of providing at least one substantially opaque panel, preferably having a background color which contrasts with the print color to be applied, and a substantially transparent panel. The first panel can be pre-printed to include instructional information. A permanent adhesive can be provided between the first panel and the transparent panel, along an overlapping edge of the two panels for affixing together these panels. A second substantially opaque panel, having a background color in contrast to the print, can also can be pre-printed and overlappingly affixed to the transparent panel at its edge opposite that of the first panel. The second panel and transparent panel can be affixed by an adhesive means disposed between overlapped edges of the second panel and the transparent panel. The first and second panels are preferably affixed to the transparent panel by slightly overlapping the edges to form a substantially inseparable bond.

Means for affixing a panel of the form to the package or affixing one panel to another in a manifold configuration can also be applied to the panels. Preferably, adhesive is applied in strategic locations parallel and proximate to the overlap junctures of the panels. A pair of adhesive strips can be applied near the junctures of the first and second panels with the transparent panel to affix the transparent panel to the package. Another strip of adhesive is applied to the second panel just inside or offset from the juncture edge such that the outer edge of the first panel can be affixed thereto when folded over the second panel. More preferably, the adhesive is applied as a continuous strip, as intermittent dots, or as spots of adhesive alternating with spots of adhesive-release material, along an edge of a contacting face of the panels. The adhesive strips are preferably covered by a peel-off, protective covering that can be removed to expose the adhesive for use.

Instructional information, including diagrams for directing appropriate use of the form can be pre-printed on either face of the first and second panels.

The subject invention also concerns novel chemical coatings for providing carbonless transfer of information inscribed on a top panel of the form to underlying panels. The chemical coating of the subject invention advantageously provides for improved transparency of the transparent panel and adheres to the transparent material better than conventional coatings.

BRIEF DESCRIPTION OF THE DRAWINGS

Preferred embodiments of the subject invention are hereafter described with specific reference being made to the following Figures, in which:

FIG. 11 illustrates a side view of a three-part mailing form illustrated in FIG. 10. This figure illustrates the interconnecting layers of the panels forming the form and is not to scale.

FIG. 12 illustrates the second embodiment of the subject invention in operational use.

DETAILED DESCRIPTION OF THE INVENTION

Figure 2:
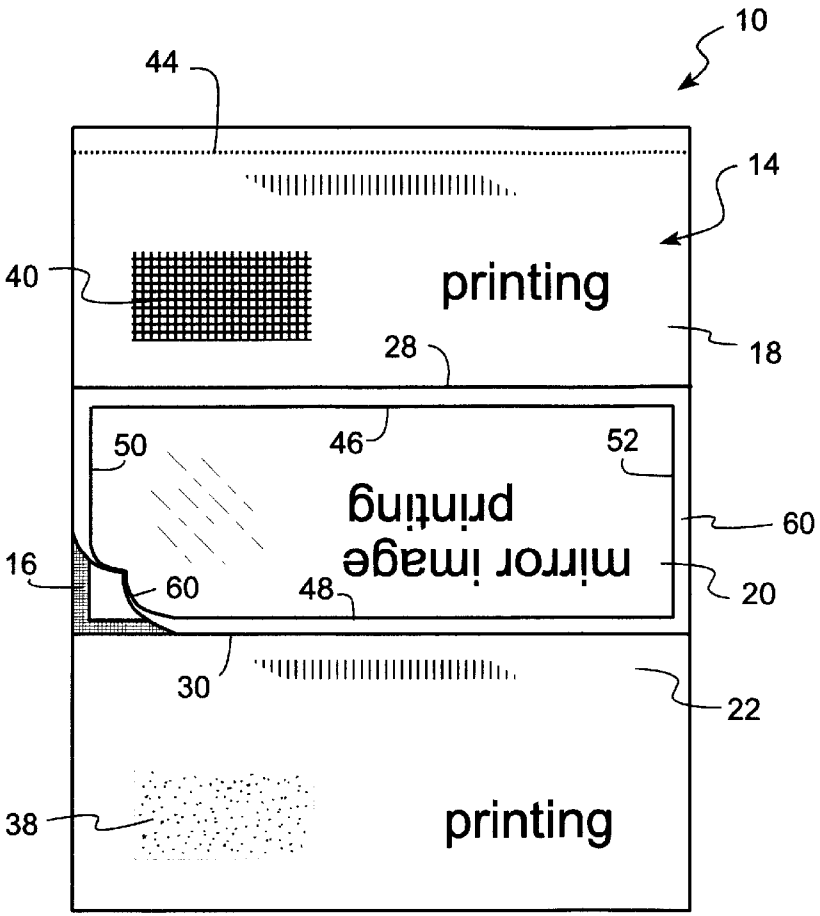
FIG. 2 illustrates a plan view of the back face of the three-part airbill form of the subject invention.
Figure 1:
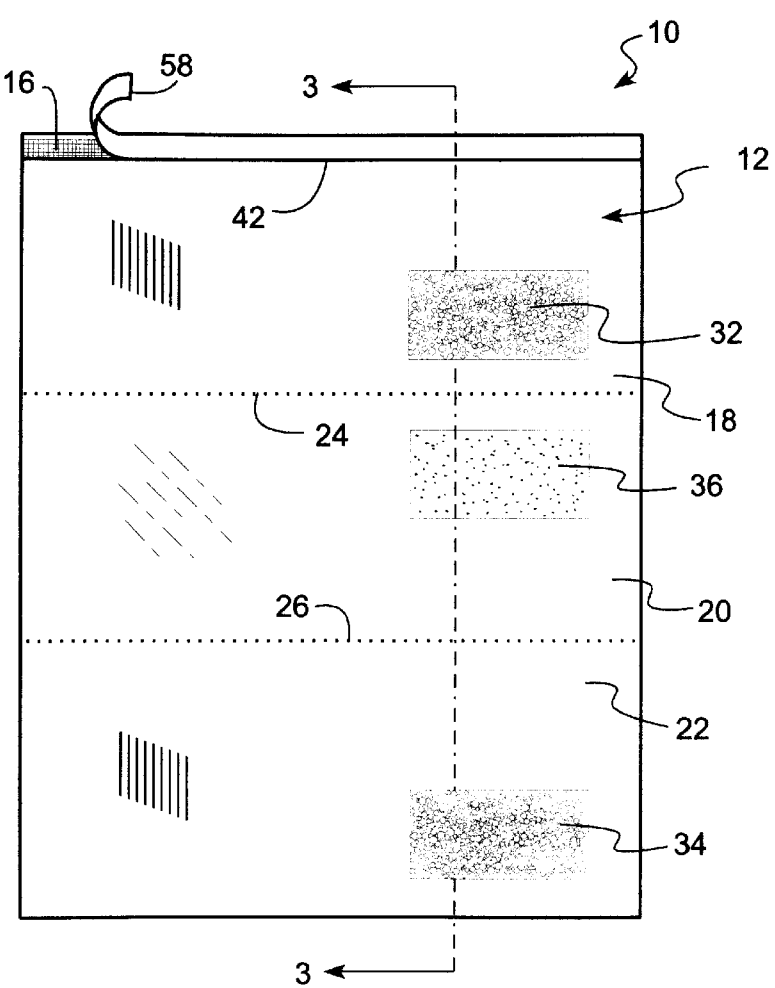
FIG. 1 illustrates a plan view of the front face of a three-part airbill form constituting a first preferred embodiment of the subject invention.
Figure 3:
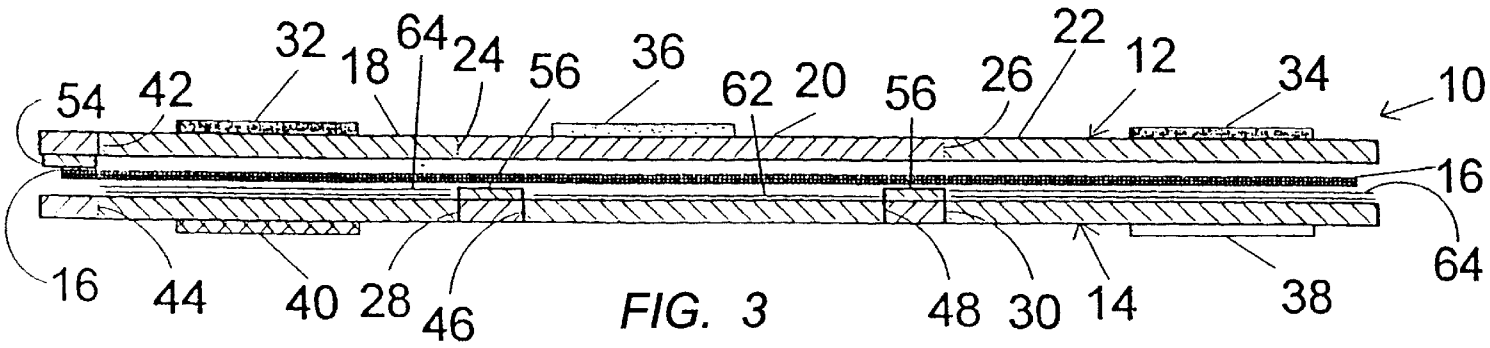
FIG. 3 illustrates a cross-sectional exploded view taken across lines 3—3 of FIG. 1.

Referring to FIGS. 1, 2 and 3, a three-part airbill form 10 is shown and constitutes a first embodiment of the subject invention. As best seen in FIG. 3, airbill form 10 has two plies, 12 and 14, superimposed and affixed together by a permanent, pressure sensitive, adhesive 16. FIG. 1 shows the outward facing face of top ply 12 of airbill form 10 and FIG. 2 shows the outward facing face of bottom ply 14. In the first embodiment, airbill form 10 is divided into three panels, top panel 18, middle panel 20 and bottom panel 22, each of which is one of the three-parts of airbill form 10. The three panels 18, 20 and 22 may respectively be the proof of delivery receipt; the addressee's receipt; and copy for the finance department of the air courier service, which is used for billing purposes. In the three-part airbill form 10, there is no sender's receipt, as it is contemplated that computers will be used to generate the address information and the sender's receipt information, such as the airbill number, can be stored in the computer generating the addresses. Where a sender's receipt is desired, a four-part variation of this embodiment, shown in FIGS. 7, 8 and 9, may be used.

Each of the two plies 12 and 14 may preferably be a transparent polyester film, such as Melinex 1311, one distributor of which is Plastic Suppliers, 1174 Hayes Industrial Drive, Marietta, Ga., 35062. Melinex 1311 is a clear film with anti-static properties on both surfaces of its web. Its surface resistivity, independent of gauge, is $2\times10^{10}$ ohms/square, which overcomes the static electricity and laser corona-based problems which generally prevent stacks of plastic films from being used with laser printers. Moreover, Melinex 1311 film does not suffer from unacceptable shrinkage when passed through the high heat of the fusing stage of a laser printer. Melinex 1311 polyester film is described in more detail in U.S. Pat. No. 4,371,489 in the name of Patrick T. McGrall and entitled "Production of Antistatic Thermoplastic Films". Additional problems encouraging the use of Melinex 1311 film are discussed in co-pending patent application Ser. No. 08/394,062, filed Dec. 1, 1994, and entitled "Transparent Security Pocket Compatible With Non-impact Printers".

The three panels 18, 20 and 22 on ply 12 are separated by perforated cuts 24 and 26 through ply 12 and the three panels 18, 20 and 22 on ply 14 are separated by die cut lines 28 and 30 through ply 14. These cuts 24, 26, 28 and 30 permit the panels 18 and 22 to be separated after plies 12 and 14 are affixed together by adhesive 16, printed, folded, and applied to a package to be sent, as explained in more detail hereafter.

For airbill form 10 to be most efficiently used with a standard non-impact simplex printer, it is desirable that the printing only occur on one face of airbill form 10. In the first embodiment of airbill form 10, as shown in FIGS. 1–3, the printing by the non-impact printer occurs on the outward facing face of back ply 14 and comprises, at least, the addressee's address. Airbill form 10 is normally pre-printed during manufacture with constant information and instructions so as to appear similar to currently existing air courier airbill forms. For example, lines defining the addressee and return address blocks and instructions may be pre-printed, together with lines for signatures, accounting information, tracing information, and the like. Items, such as the sender's return address, account number and airbill number (in both digital and bar code format) may be either pre-printed or printed by the non-impact printer, depending upon the number of airbill forms ordered from the air courier service by the user/sender.

Certain information, such as internal tracing information, addressee's signature and accounting or billing information, can be manually added to the airbill form after a package is transmitted by the sender and this information also should appear on all copies of airbill form. In order to permit later added information to be manually added on the top sheet only, coatings of chemically mated imaging materials are placed on the facing faces of plies 12 and 14 of the first embodiment, or on each of the panels of the second embodiment, to form carbonless copies. As is well known, carbonless copies can occur where layers known as a CF (coated front) coating and a CB (coated back) coating are facing one another. A CF coating is a-dry chemical coating on which the information appears and a CB coating is containing microcapsules, each of which, in turn, contain a wet chemical. Where a CF coating and a CB coating are facing one another, adequate pressure will cause the capsules to rupture and a chemical reaction occurs between the dry and wet chemicals, thereby causing an image to appear.

Such coatings are well known and commercially available from several vendors.

In three-part airbill form 10, CB coatings 32 and 34 are placed on panels 18 and 22 of ply 12, respectively, and CF coatings 36 and 38 are placed on panel 20 of ply 12 and panel 22 of ply 14, respectively. The CB coatings 32 and 34 and CF coatings 36 and 38 are positioned so that when panel 22 is folded along lines 26 and 30 to be over panel 20 and then panel 18 is folded along lines 24 and 28 to be over panel 22, the CB and CF coatings 32, 34, 36 and 38 are aligned with one another and a CF coating 36 and 38 and a CB coating 32 and 34 face one another with the CF coating positioned to receive the image. The variation shown in these figures has such coatings in discrete areas of the ply. However, it would be understood that the plies can receive full-face coating so that any area normally inscribed can transfer the image to the underlying ply.

Because it is difficult to write on a plastic film, a matte coating 40 is placed on panel 18 of ply 14, which also is aligned with the CF and CB coatings 32, 34, 36 and 38 and is positioned on the outward facing surface of panel 18 after airbill form 10 is folded as explained above. One example of a matte coating which may be used with the airbill form 10 is Craigcoat 1025M, manufactured and sold by Craig Adhesives and Coating Company of Newark, N.J. These matte coatings can also be applied to the full face of the ply.

In addition to the perforation cuts 24 and 26 and die cut 28 and 30, a die cut 42 and aligned-perforation cut 44 are placed approximately one-fourth to one-half of an inch below the upper edge of plies 12 and 14, respectively. Further, die cuts 46, 48, 50 and 52 are placed in panel 20 of bottom ply 14, approximately one-fourth to one-half of an inch away from die cuts 28 and 30 and the outer edges of ply 14.

Referring now to FIG. 3, an exploded cross-sectional view, taken across lines 3—3 of FIG. 1 is shown, where it is seen that top and bottom ply 12 and 14 are held together by adhesive 16. A layer of silicone release material 54 is placed on the interior surface of top ply 12 and in alignment with die cut 42 and perforation cut 44. An additional layer of silicone release material 56 is placed on the interior surface of bottom ply 14 in alignment with and between die cuts 46 and 28, die cuts 48 and 30, die cuts 50 and the edge of ply 14 and die cut 52 and the edge of ply 14. The addition of the silicone material layer 54 permits a strip 58, defined by die cut 42 and the edge of ply 12, to be peeled away, as best seen in FIG. 1.

Release product components, manufactured by the GE Silicones division of General Electric Company, U.S.A., yield such a compatible release material. More specifically, the use of UV9400 solventless UV release polymer, in combination with UV9380C or UV9310C photocatalysts, can be photocured in air, upon irradiation with UV radiation of less than 300 nm wavelength, to provide a silicon release material having a tightly cross-linked epoxysilicone network. GE Silicones 1178-116 Viscosity Modifier can be used to help in forming precise patterns or discrete areas of release coating 24.

Figure 5:
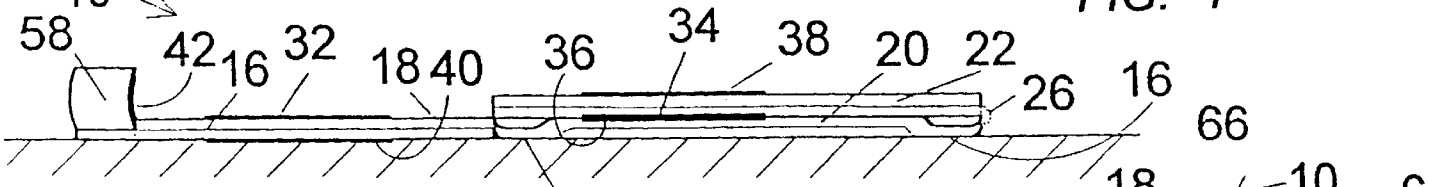
FIG. 5 illustrates an intermediate step in affixing the airbill form of the subject invention to a package.
Figure 6:
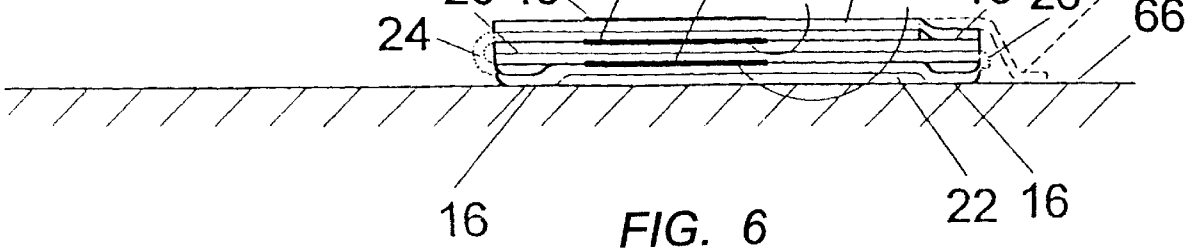
FIG. 6 illustrates the final step in affixing the airbill form of the subject invention to a package.

The addition of the silicon material layer 56 permits a rectangular strip 60, defined by die cuts 46 and 28, die cuts 48 and 30, die cut 50, and the edge of ply 14 and die cut 52 and the edge of ply 14, to be peeled away, as best seen in FIG. 2. When strip 58 and rectangular strip 60 are peeled away, adhesive 16 is exposed. The exposed adhesive 16 below rectangular strip 60 is used to affix the folded airbill form 10 to a package, as seen in FIGS. 5 and 6, and the exposed adhesive below strip 58 is used to affix airbill form 10 together as a folded three-part airbill form, as seen in FIG. 6. As seen with respect to strips 58 and 60, adhesive 16 is coated to be slightly remote from the edge of airbill form 10, to prevent bleeding of adhesive material prior to and during the use of airbill form 10.

Adhesive 16 should be a transparent adhesive and should have a good affinity to both plies 12 and 14, as well as having the ability to affix airbill form 10 to a package, which typically is a paper or cardboard material. One commercially available adhesive which has been found to be acceptable is a compounded synthetic polymer, such as Craigcoat 1051G, manufactured by Craig Adhesives and Coatings Company, of Newark, N.J.

As noted above, airbill form 10 is pre-printed during manufacture to closely resemble existing air courier airbill forms. This requires printing both a background color, such as white, and the information, which may be printed in various colors. For example, a U.S. Postal Service Express Mail airbill form has orange and blue borders and printing and a white background on all parts. On some sheets, black printing used to identify the airbill number in both readable format and bar code format is also present. Similarly, a Federal Express airbill form has blue, orange, yellow and black printing with a white background on two sheets, light blue, and yellow printing with a white background on a third sheet and blue and orange printing with a pink background on a fourth sheet, used as the customer's receipt.

The pre-printing, as shown in FIG. 3, is preferably placed on the interior facing face of ply 14, and is done in two separate steps. First, the foreground information, represented by line 62, is printed over all three panels 18, 20 and 22. Foreground information 62 is printed in a standard readable format (when looking directly thereat) on panel 20 and in a mirror image and opposite direction format on panels 18 and 22. Next, the background color printing 64 is printed only over panels 18 and 22, leaving panel 20 with a transparent background. As noted above, different background colors 64 may be printed on panels 18 and 22 where different color panels, or parts, of airbill form 10 are desired. By pre-printing the background color (or colors) 64 only on panels 18 and 22, middle panel 20 is transparent and top and bottom panels 18 and 22 appear as a conventional opaque air courier airbill. Alternatively, only the background color 64 may be pre-printed on the interior facing face of ply 14 and all of the information 62 may be printed by the non-impact printer at the time airbill form 10 is being used.

It should be noted that the silicone layers 54 and 56 are added after the foreground and background printing 62 and 64 occurs, so that information can be printed and viewed on strips 58 and 60. It further should be noted that instructions or other information may be pre-printed on the outward facing face of panels 18 and 22 of ply 12.

After airbill form 10 is manufactured, as described above, it is a flat sheet of conventional standard size, such as 8½"×11" or A4, and is ready for use by a user. The user generated information to be printed includes both the addressee information and any other information desired by the user, such as return address (if not pre-printed), customer numbers, shipping or delivery information or instructions, billing or fee information, airbill number, and the like. The user generated information should be printed on the outward facing face of ply 14, so that it is remote from CB coatings 32 and 34, which can be damaged by the heat in some types of non-impact printers, such as a laser printer. The format of the user generated printed information is shown in FIG. 2, where it is seen that the printing on opaque panels 18 and 22 is conventional and readable and the printing on transparent panel 20 is in a mirror image format and in the reverse direction relative to the printing on opaque panels 18 and 22. This is opposite to the pre-printed format. Care should be taken to assure that the direction of the printing, both pre-printed and user generated, is in the same direction so that the information is printed in the correct blocks. Thus, an arrow indicating feed direction may be a part of the pre-printed information on one of the panels 18 or 22.

A computer program may be used to generate the user information and format to be printed and to send that information to the non-impact printer in a known manner. Such a program forms no part of this invention and is well within the state of the art.

Figure 4:
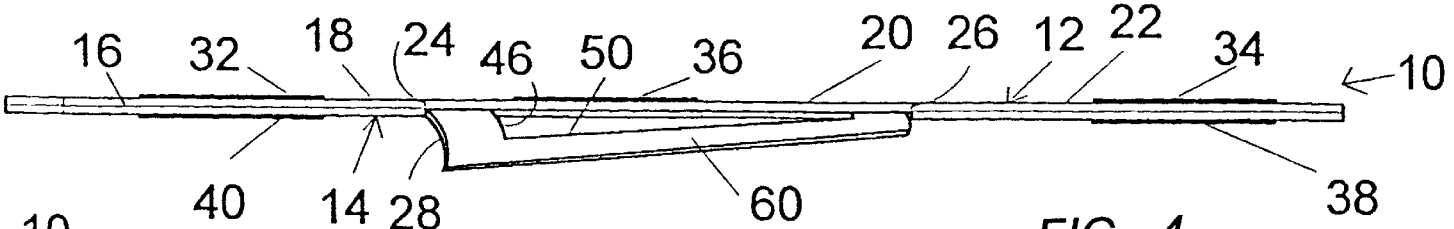
FIG. 4 illustrates the first step in affixing the airbill form of the subject invention to a package.

Referring now to FIGS. 4–6, the manner of affixing airbill form 10 to a package 66 will be described. After the user generated information is printed, rectangular strip 60 is removed, as seen in FIG. 4, thereby exposing the adhesive 16 thereunder. Airbill form 10 is then placed on package 66 so that it becomes affixed thereto by applying a slight pressure above exposed adhesive 16. Next, the ply 14 face of middle panel 20 is affixed to package 66, by applying a slight pressure above the exposed adhesive 16 at rectangular strip 60. At this point, the package 66 forms the background color for transparent middle panel 20, thereby permitting both the pre-printed and user generated printing thereon to be easily readable. As previously noted, the pre-printed information on the interior face of panel 20 on ply 14 is printed in a directly readable format on the interior facing face of ply 14 at panel 20 and the user generated printing on the outward facing face of ply 14 at panel 20 is printed in a reverse mirror image format. Thus, a person can easily read all of the information through transparent panel 20 when it is affixed to package 66.

After airbill form 10 is affixed to package 66, panel 22 is folded about perforation line 26 to the position shown in FIG. 5. Then, strip 58 is removed and panel 18 is folded about in perforation line 24 to the position shown in FIG. 6. At that point, the adhesive 16 exposed by the removal of strip 58 is affixed to panel 22 by applying a slight pressure. This completes the affixation of airbill form 10 to package 66. While panel 18 is shown as affixed to panel 22, the dimensions and positioning of panels 18, 20 and 22 may be arranged so that the exposed adhesive 16 below strip 58 is affixed directly to package 66, as seen by the dashed lines 68 in FIG. 6.

As seen in FIG. 6, each of the CB layers 32 and 34, the CF layers 36 and 38 and the matte layer 40 are in alignment after folding and affixation of airbill form 10 to package 66. Further, a CB layer 32, 34 and a CF layer 36, 38 are facing one another between panels 20 and 22 and between panels 22 and 18. Thus, when information is manually added to airbill form 10 by either personal of the air courier service. or by the addressee signing the proof of delivery receipt, that information is added over matte layer 40 and appears on the CF layers 36 and 38 on panels 20 and 22.

During transit of package 16, the three-parts of airbill form 10 may be separated by manual separation along perforation lines 24 and 26 and panels 18 and 22 of airbill form 10 may be sent as desired by the delivery person, leaving the affixed panel 20 as the addressee's receipt.

Figure 8:
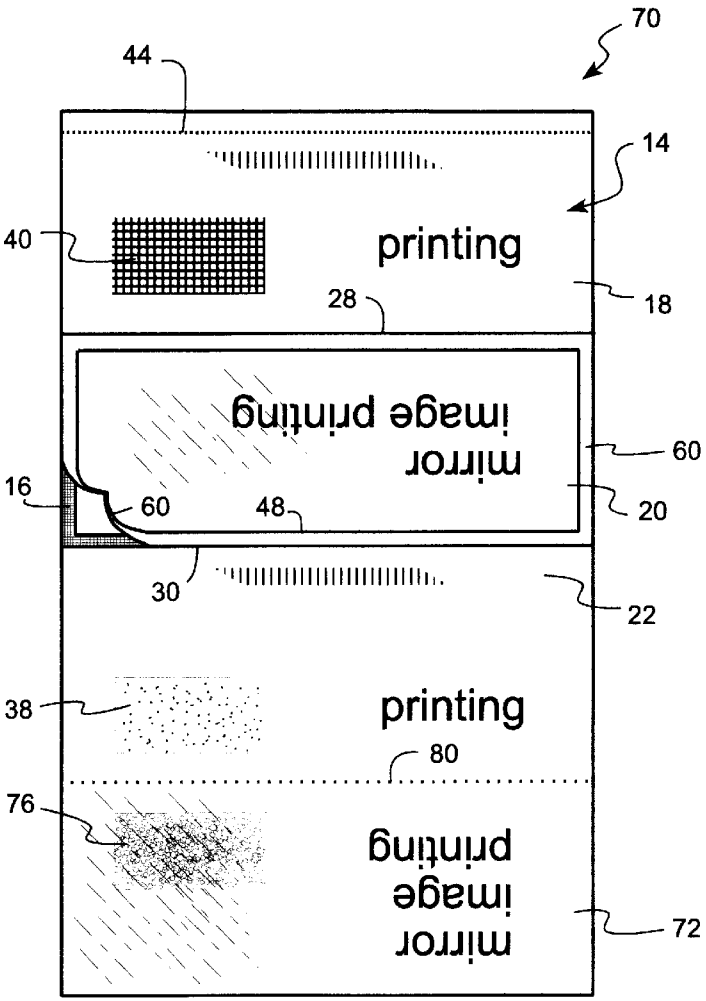
FIG. 8 illustrates a plan view of the back face of the four-part airbill form.
Figure 7:
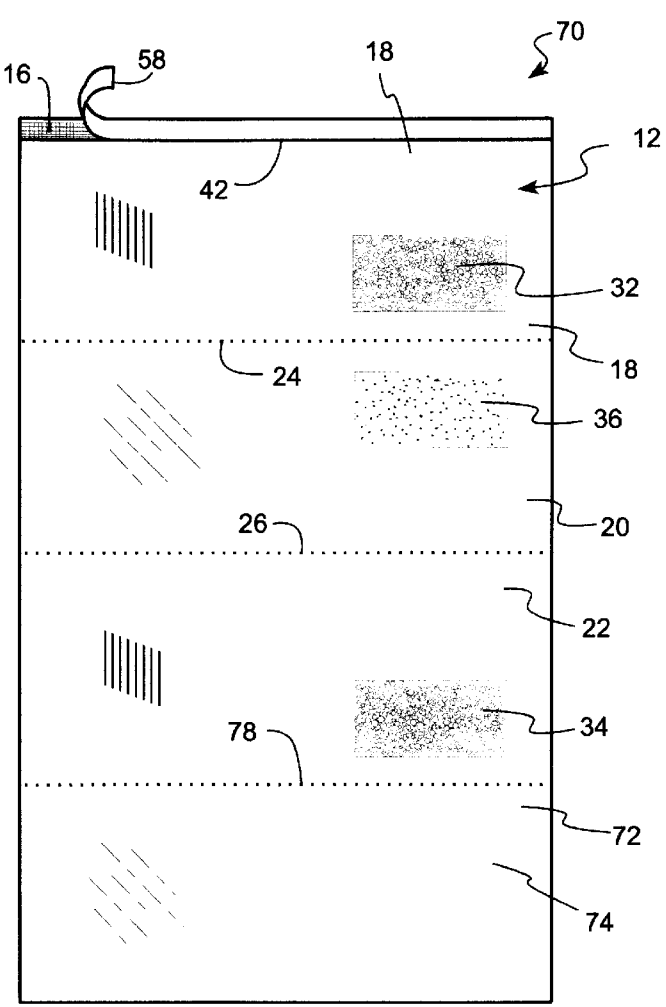
FIG. 7 illustrates a plan view of the front face of a four-part airbill form constituting a variation of one preferred embodiment of the subject invention.
Figure 9:
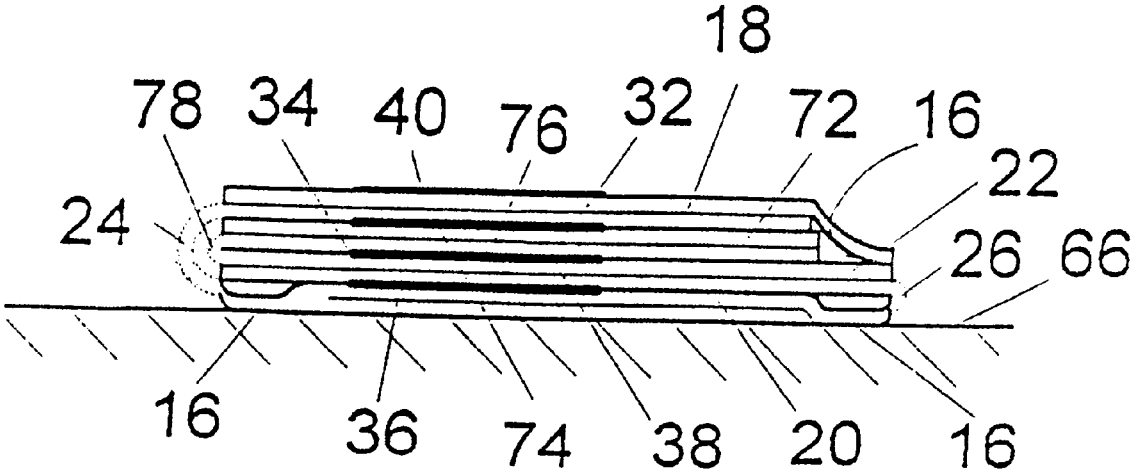
FIG. 9 illustrates the four-part airbill form affixed to a package.

Referring now to FIGS. 7–9, a four-part airbill form 70 is shown. Airbill form 70 is generally similar to airbill 10, shown in and described with respect to FIGS. 1–6, except that a fourth panel 72 is added below panel 22. In FIGS. 7–9, like numerical designations are given for identical components previously described. The outward facing face of panel 72 on ply 12 has a CF coating layer 74 applied thereto-and the outward facing face of panel 72 on ply 14 has a CB coating layer 76 applied thereto. Further, the length of panel 72 is slightly shorter than the other panels 18, 20 and 22, so that a standard 8½ by 14 inch sheet may be used for airbill form 70. On ply 12, panel 72 is separated by a perforation cut 78 from panel 22 and on ply 14, panel 72 is separated from panel 22 by a die cut 80. The printing on panel 72 is similar to that described above for panel 20.

In using airbill form 70, first rectangular strip 60 is removed and airbill form 70 is affixed to package 66 as described above with respect to airbill form 10. Next, panel 72 is folded about perforation cut 72 so that the panel 72 of ply 14 faces panel 22 of ply 14. Thereafter, the assembly of airbill form 70 is generally the same as with airbill form 10, in that panels 72 and 22 are folded along perforation cut 26, strip 58 is removed, panel 18 is then folded along perforation cut 24 and the exposed adhesive 16 from the removal of strip 58 is used to affix panel 18 to panel 22. The reason that panel 18 is affixed to panel 22 is that panel 72 is slightly shorter than the other panels 18, 20 and 22. Alternatively, the exposed adhesive 16 on panel 18 may be affixed to package 66, as seen by the dashed lines 68 in FIG. 6.

While the subject invention has been described with reference to the preferred embodiments, many variations are possible within the scope and spirit of the invention. For example, any number of panels may be designed by either adding additional panels to those shown and described or by removing panels from the three panel embodiment of form 10. Further, the pre-printed matter may be on the outward face of ply 14, in which case the pre-printed information will be over printed by the non-impact printer, in this case, the pre-printing on panel 20 and 72 will be the mirror image format. In this case, the pre-printed background color will be printed first and then the pre-printed information will then be printed over the background color. In addition, the background color and pre-printed information may be printed on different plies 12 and 14; for example, the background color 64 may be printed on the interior face of ply 12 and the pre-printed information 62 may be printed on the interior face of ply 14.

Another alternative is to use a low tack, pressure sensitive, adhesive coating in alignment with strip 58 in place of high tack adhesive 16. One such low tack adhesive is Craig-Stik 3991PI, manufactured and sold by Craig Adhesives and Coating Company, of Newark, N.J. Low tack adhesives are commonly used with self stick note pads, where a sheet of paper can be easily removed without tearing from the pad and affixed to another object. By using the low tack adhesive, it is unnecessary to include the silicone layers 54; in addition, perforation 44 may be eliminated, since the end of panel 18 can be easily removed from affixation to panel 22. It should be noted that permanent adhesive 16 is still used in areas other than in alignment with strip 58.

Figure 10:
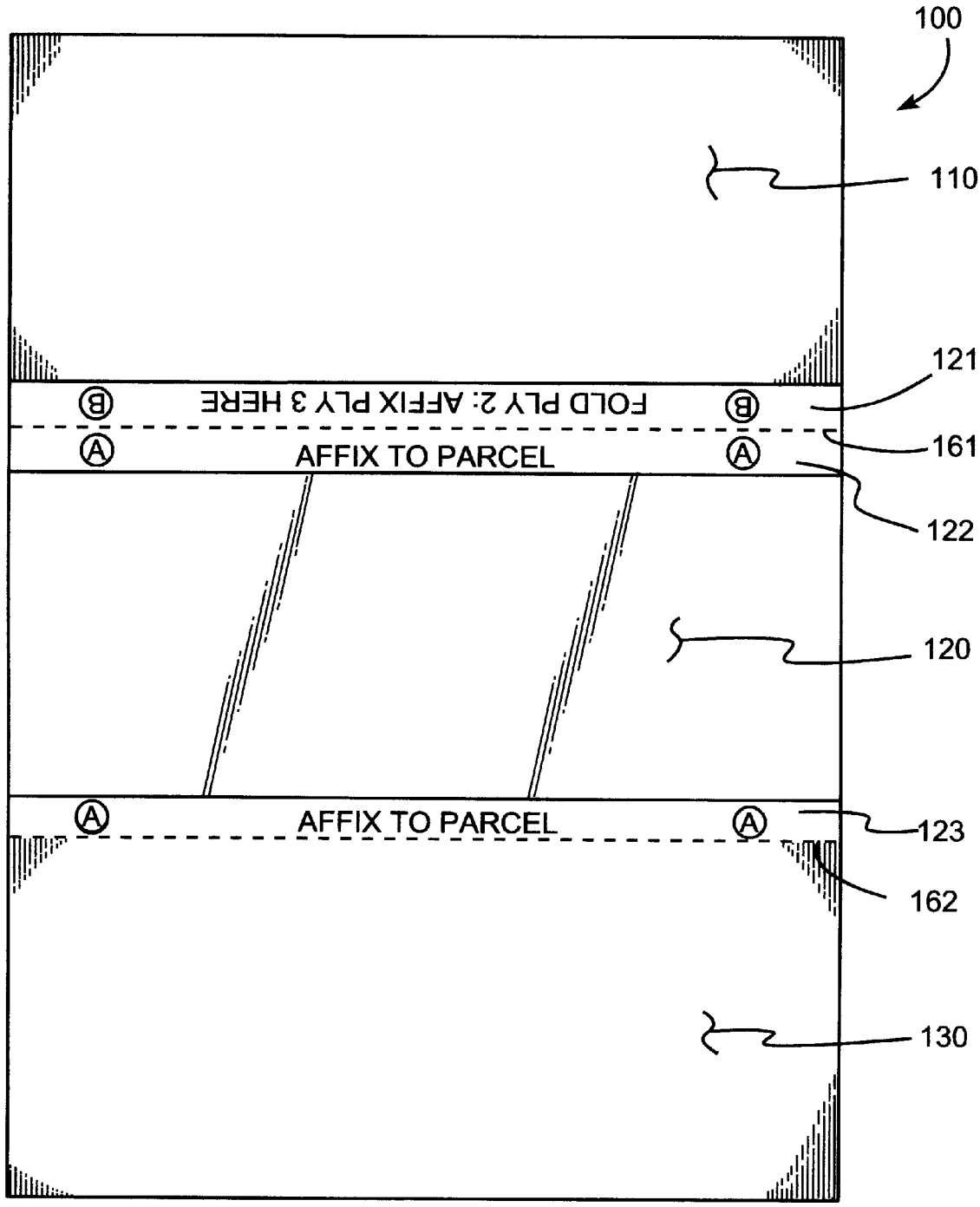
FIG. 10 illustrates a plan view of a front face to be printed on by a non-impact printer of a three-part address form which constitutes a variation of a second preferred embodiment of the subject invention.

In describing the second preferred embodiment, reference is made to FIGS. 10–12. FIG. 10 is a front view of the form 100 showing the face to be printed on by a non-impact printer. The form comprises three separate panels: first panel 110; second panel 130; and third, transparent panel 120. The three panels are adjoined by overlapping and adhering one edge of each of the first and second panels 110 and 130 to opposite edges of the transparent third panel 120. Releasable protective coverings 121, 122, and 123 are shown overlaying adhesive strips. The adhesive strips are disposed on the form to provide adherence to the package or for adhering panels to one another when forming the manifolded form.

Figure 11A:
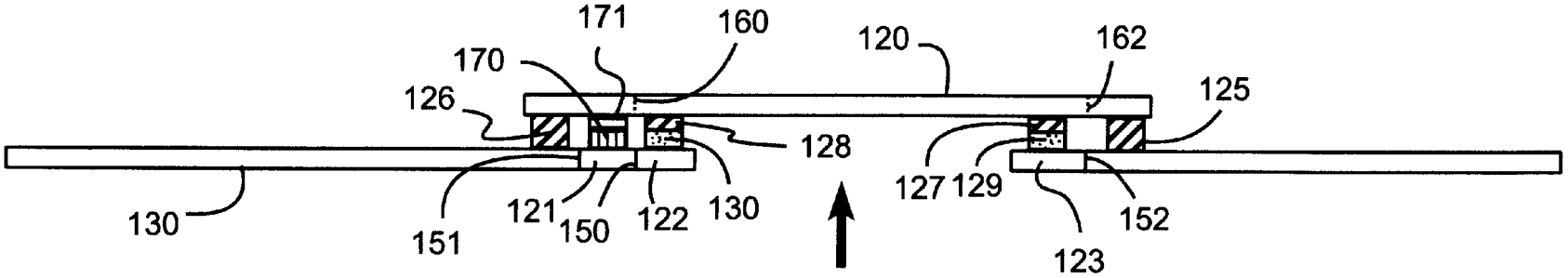
FIG. 11*a* illustrates a configuration wherein the first and second end panels overlap and connect to one and the same face of the middle panel.
Figure 11B:
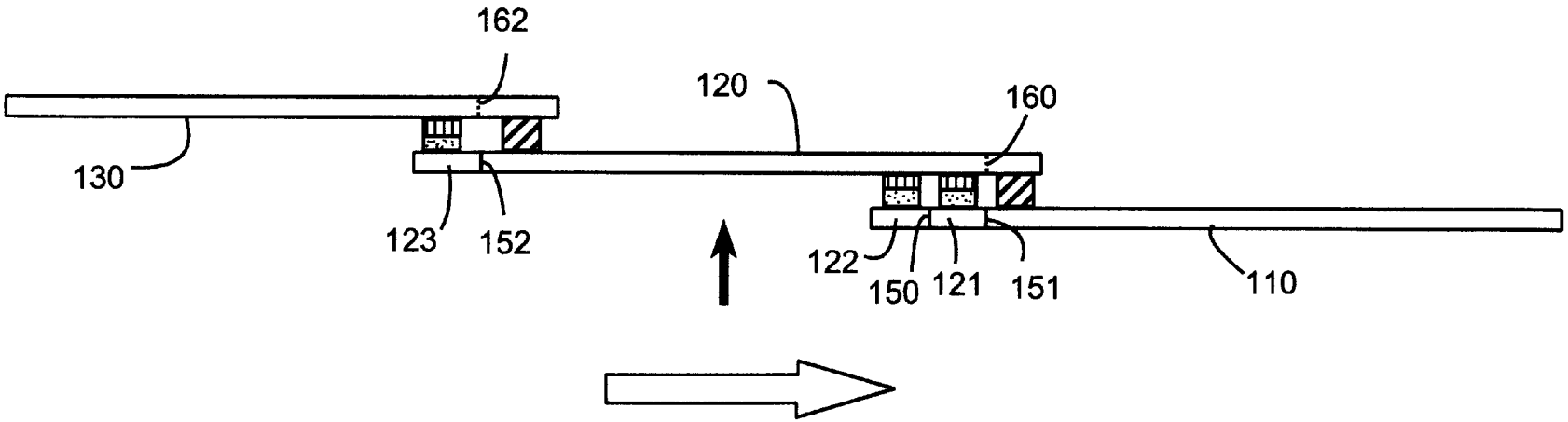
FIG. 11*b* is an exploded view illustrating a "stair-step" overlapping configuration whereby the end panel which first passes through the printer (fed into the printer in the direction of the arrow) is overlapped by the transparent panel, which in turn is overlapped by the end panel which last passes through the printer.

The overlapping configurations of the panel edges are illustrated in FIGS. 11*a* and 11*b*. One configuration, shown in FIG. 11*a,* provides the first and second panels 110 and 130 overlapped on the same face of the substantially transparent panel 120. It would be understood that the first and second panels can overlap the opposite face of the transparent panel.

Printing by a non-impact printer is applied to each of the panels on the face indicted by the solid arrow. Adhesive strips 125 and 126 are disposed between the overlapping panels to permanently affix the panels together to form a single sheet. Preferably, the adhesive strips are applied to substantially cover a linear area of overlap of the panels, preferably proximate and parallel to the outer edges of the transparent panel 120 to retain the integrity of the adjoined panels as a single sheet. The adhesive for attaching the panels together is well known and commercially available, examples of which are described herein.

A "stair-step" overlapping configuration of the subject form is shown in FIG. 11*b*. The "stair-step" overlap configuration is preferred for purposes of feeding the form through the printer (in the direction of the open arrow) to avoid nesting in the printer tray mechanism.

In either configuration, each of the adjoined panels is approximately one-third the length of the form. Therefore, each of the panels is slightly longer than one-third the length of the form so that they can coextensively overlap with another of the panels. In one embodiment, the transparent panel 120 overlaps approximately 0.75 inches with the first panel 110, and overlaps about 0.5 inches with the second panel 130 (see FIGS. 11*a* and 11*b*).

In addition, adhesive means can be applied to an inner face of the substantially transparent panel 120 for mounting the form to a package or other item to be mailed. These adhesive strips 127 and 128 can be disposed as a single, relatively broad, continuous line or pattern. Adhesive-release material can be applied as opposing strips 129 and 131 on the inner face of first and second panels 110 and 130, respectively. The adhesive-release strips 129 and 131 allow for removal of protective strips 122 and 123 along die-cuts 150 and 152, respectively. Removal of protective strips 122 and 123 also removes adhesive-release strips 131 and 129 so that the form can be affixed to a package by the underlying adhesive strips 127 and 128.

Perforations 160 and 162 can be formed through the substantially transparent panel 120, positionally corresponding to die-cuts 150 and 152, respectively (or 151 and 152 in the stair-step configuration shown in FIG. 11*b*) to provide the dual purpose of facilitating folding of the form, and to allow the top panels to be separated from the middle panel which is permanently adhered to the package. The perforations further divide the form into three separable panels, each approximately equal in size.

Strips of alternating adhesive and adhesive-release material can be disposed on opposing faces of panels 120 and 130, between die-cuts 150 and 151, which form protective strip 121 therebetween. Preferably, the alternating adhesive/adhesive-release material is disposed such that strips of adhesive having intermittent spots or areas of adhesive-release 170 is disposed on the inner face of protective strip 121, and strips 171 of adhesive-release material having intermittent spots or areas of adhesive material are disposed on an opposing face of panel 120. More preferably, the areas of adhesive on one panel face correspond to adhesive-release on the opposing panel. This configuration allows for controlling the amount of tack, i.e., strengthening the bond between the opposing panels, permitting the form to undergo printing operations without destroying the integrity of the form during printing operation. This alternating configuration of adhesive/adhesive-release material further allows exposure of a controlled amount of adhesive in strip 171 to adhere the outer edge of panel 110, which is subsequently folded at perforation 162 and die-cut 152, over panels 120 and 130 during use of the form.

Figure 12A:
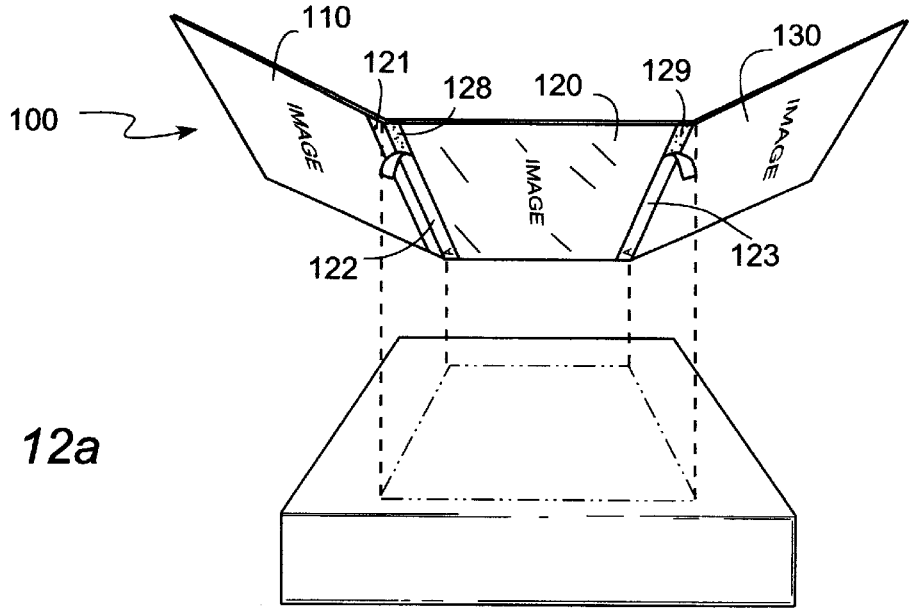
FIG. 12*a* shows adhesive strip coverings being removably affixed over adhesive strips for affixing the center transparent panel onto an item to be mailed.
Figure 12B:
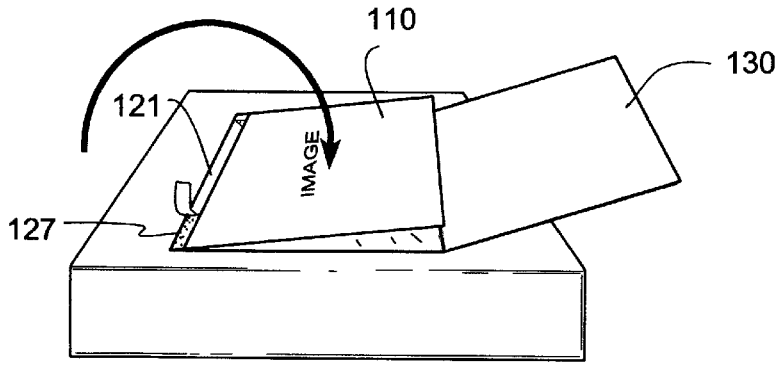
FIG. 12*b* shows the first panel being folded over the transparent panel to form a second layer of the form, and the adhesive strip protective cover being removable to expose an adhesive for suffixing the second strip to a panel thereto.
Figure 12C:
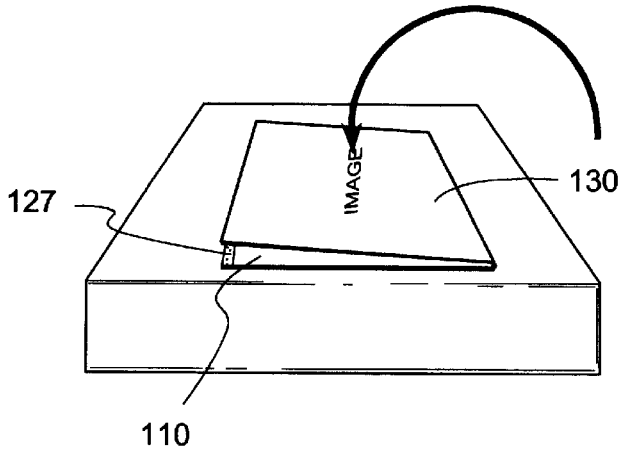
FIG. 12*c* shows the second panel being folded over the first panel affixing to the exposed adhesive strip, thereby forming a three-layer mailing form.

In operational use, as illustrated in FIGS. 12*a*–12*c,* this second embodiment of the subject mailing form is printed on a single face when the form is in a flat configuration. The printed information, e.g., address information, is printed in a way so that the information is readable from one and the same direction on each panel when the form is in use, i.e., in folded configuration. Thus, the printed face of the transparent panel 120, which is placed face down when applied to the package, is printed as a mirror image of the indicia printed on the first and second panels, 110 and 130, respectively. This allows the indicia to be read in normal configuration, i.e., left to right, when applied to the package. The first panel 110 and second panel 120 are both printed to be read in a normal configuration when the printed face is folded over in a face-up position.

Preferably, the paper used for the second embodiment of the subject invention is a commercially available paper product, which can be chemically coated for making carbonless copies as described. For example, the first and second panels can be made from standard carbonless paper of appropriate thickness or weight. The transparent panel can be made from Patapar™, available from Patterson Paper Co., or preferably, is a static-free polyester which is commercially available. It is preferred to use materials which are resistant to the heat that can be generated by conventional non-impact printers. Such carbonless paper and polyester materials, including heat-resistant paper materials are commercially available.

The chemical coating applied to the panels allows for additional marking, e.g., signature, to be placed on the outside panel when the form is in its folded configuration, and the marking is chemically manifolded or transferred onto the other two panels. For best efficiency in achieving this for the second embodiment, the first panel 110 is coated face and back (CFB); the transparent panel 120 is coated face (CF); and the second panel 130 is coated back (CB).

For providing effective adherence to the form materials while retaining highly transparent properties (high-quality transparent materials typically being very smooth and therefore slick and resistant to adhesives), the carbonless transfer coating has been modified from conventionally available formulations. The modified carbonless transfer coating of the subject invention comprises zincated alkyl salicylate salt, colloidal alumina, and conventional binder, e.g., NuCoat #4168, in water. In a preferred embodiment, the novel coating can be prepared in 5 gallon batches (18,144 gms), according to the following formulation:

| Material ID | Quantity (grams) |
|---|---|
| Water (de-ionized) | 7,929.00 |
| Schenectady HRJ-14063 Zincated Alkyl Salicylate Salt 52% Solids | 689.50 |
| Nyacol Al-20, 20% Solids Colloidal Alumina | 8,618.40 |

-continued

| Material ID | Quantity (grams) |
|---|---|
| NuCoat #4168 Pre-made Binder Solution, 40% Solids | 907.10 |
| Total | 18,144.00 |

The mixture is agitated slowly using a prop blade for about 15 to 30 minutes at ambient temperature, e.g., about 76 degrees F. The resulting coating formulation has the following properties:

% O'Haus Solids 15%;

Orion #250 $p^h$ 3.6 (varies depending upon water supply); and

DV-11, 20 RPM, #1 spindle Viscosity 8 CPS.

The coating formulation is preferably stored in a tightly sealed container.

Samples were tested for opacity and showed the following results:

TABLE 1

Opacity Results on Selected Samples

| Sample | R (information) | R (O) | Opacity, ISO |
|---|---|---|---|
| (1) | 30.7 | 11.4 | 36.9 |
| (2) | 30.1 | 10.9 | 36.2 |
| (3) | 30.5 | 11.5 | 37.7 |
| (4) | 32.8 | 11.7 | 35.8 |
| (5) | 23.9 | 8.6 | 35.9 |
| (6) | 29.7 | 10.6 | 35.7 |
| (7) | 26.9 | 9.2 | 34.4 |
| (8) | 19.2 | 7.2 | 37.5 |

R (Information) - Value @ 1 sheet folded twice (4 plies)
R (O) - Single sheet measurement It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A multi-part form for use as a mailing form on a package, wherein information is printable by a non-impact printer on one face of said form, said form comprising:

a first panel having a substantially opaque background; and a substantially transparent or at least translucent panel, said transparent/translucent panel being separable from said first panel by means permitting folding to superimpose said first panel over said transparent/translucent panel;

said information being printed on said one face of each of said panels such that said address information on said transparent/translucent panel is printed as a mirror image to the information printed on said first panel;

means for affixing at least a portion of said one face of said transparent panel to said package; and means for affixing at least a portion of said first panel to the transparent/translucent panel or to said package.

2. A multi-part, partially pre-printed, form for use as an address label on a package, in which address information is printed by a non-impact printer on one face of said form proximate to the time said form is to be used, said form comprising:

a first panel and second panel on which certain information is printed so as to be viewed against an opaque background; and a third panel which is at least translucent or substantially transparent disposed between said first and second panels, and on which said certain information is printed, wherein said third panel is disposed between said first and second panels which are foldable over said third panel said address information being printed on said one face of each of said panels such that said address information on said third at least translucent panel is a mirror image to the normally readable address information printed on said first and second panels;

means for affixing said one face of said at least translucent panel to said package; and means for affixing said second panel in folded configuration to said first panel.

3. The form according to claim 2 wherein said panels are formed by said first and second panels being overlappingly affixed to said at least translucent panel. The form according to claim 3 wherein said means for affixing said one face of said transparent panel to said package comprises adhesive disposed on said transparent panel.

4. The form according to claim 1 wherein said form includes at least one die cut through said first and second panels overlapping said at least translucent panel, said die cuts forming protective paper covers over the adhesive disposed on said transparent panel.

5. The form according to claim 4 wherein one of said panels has a second adhesive strip and protective cover.

6. The form according to claim 5, said form further having a layer of release material between said die cut protective cover and said adhesive strip so that said cover is removable to expose said adhesive.

7. The form of claim 6 wherein said second adhesive strip comprises patterned adhesive.

8. The form according to claim 7 wherein said patterned adhesive comprises alternating adhesive and adhesive-release material.

9. The form according to claim 2 wherein said first and second panels are a material having substantially opaque background.

10. The form according to claim 2 wherein said first panel is coated face and back for carbonless copying.

11. The form according to claim 2 wherein said second panel is coated back for carbonless copying.

12. The form according to claim 2 wherein said third panel is coated face for carbonless copying.

13. A method of using a multi-part form as an address form for a package, said form having a first panel for printing certain information viewed against an opaque background, and a second, substantially transparent panel for viewing certain information therethrough, one face of said substantially transparent panel further having means to affix said transparent panel to said package, said method comprising the steps of:

printing said address information on both said first and transparent panels on said one face of said form such that the address information printed on said transparent panel is a mirror image of the normally readable address information printed on said first panel;

affixing said one face of said transparent panel to said package;

folding said first panel over said transparent panel; and affixing said first panel to one of another portion of said form or said package.

14. A method of using a pre-printed multi-part form as an address form for a package, said form having a first and second panel for printing certain information viewed against an opaque back-ground, and a third at least translucent panel for viewing certain printed information therethrough, one face of said form further having means to affix said transparent panel to said package, said method comprising the steps of:

printing said address information on one face of said first, second, and third panels such that the address information printed on said transparent panel is a mirror image of the normally readable address information printed on said first and second panels;

affixing said one face of said transparent panel to said package;

folding said first panel over said third panel;

folding said second panel over said first and third panels; and affixing said second panel to first panel or said package.

15. The method according to claim 12 wherein said step of affixing said one face of said transparent panel to said package includes removing a protective cover formed by a die cut on said first and second panels to expose an adhesive, and pressing said adhesive on said package.

16. A method of manufacturing a pre-printed multi-part address form for a package, said form including a pair of transparent sheets, said method comprising the steps of:

printing foreground information, a portion of which is viewed against an opaque background and a portion of which is viewed against a transparent background, said portion viewed against said transparent background being printed in a mirror image format relative to said portion viewed against said opaque background;

disposing an adhesive on one of said sheets; and affixing said sheets together so that said adhesive is between said sheets.

17. A method for manufacturing a pre-printed multi-part address form for use as an address label on a package, said form having an at least translucent panel disposed between a first and second panel, said method comprising:

providing at least translucent panel and a first and second substantially opaque panel, said at least translucent panel to be disposed between the first and second panels such that at least a portion thereof overlappingly engages said first and second panels;

disposing a permanent adhesive on edges of the portion of said translucent panel which overlap and engage said first and second panels;

applying a coating of release material on one face of a portion of the overlapping edge of said first and second panels to allow permanent adhesion between said panels at an outer edge of said translucent panel, but removable adhesion at an outer edge of said first and second panels;

affixing said panels together to form a single overlapping sheet; and printing color or lettering on said sheet.

18. The method according to claim 17 further including the steps of:

cutting said first and second panels in the location of said release material to form removable strips in said first and second panels.

19. The method according to claim 18 further including the step of selectively coating layers of chemically mated imaging material and a writable layer on said panels positioned to be aligned with one another when said portion of said one panel and a corresponding portion of said other panel are positioned over each other in a folded configuration.

20. The method of claim 19, wherein said a least one opaque panel is cut in the location of said release material to form two removable strips.

21. The form according to claim 2 wherein said form is preprinted for use as an airbill.

22. The airbill form according to claim 21 wherein said address information is printed on each of said three panels, said printing on said third panel being a mirror image of the printing on said first panel.

* * * * *